US005940898A

United States Patent [19]

Rowe

[11] Patent Number: 5,940,898

[45] Date of Patent: Aug. 24, 1999

[54] DRAIN ASSEMBLY

[76] Inventor: Harold F. Rowe, 3533 Hildon Cir., Atlanta, Ga. 30341

[21] Appl. No.: 09/109,709

[22] Filed: Jul. 2, 1998

[51] Int. Cl.[6] ..... A47K 1/14

[52] U.S. Cl. ..... 4/286; 4/288; 4/290

[58] Field of Search ..... 4/286, 288, 290, 4/291, 287, 289, 292, 650, 680, 679

[56] References Cited

U.S. PATENT DOCUMENTS

| | | | |
|---|---|---|---|
| 3,397,902 | 8/1968 | Dutcher | 4/288 |
| 4,232,407 | 11/1980 | Williams | 4/287 |
| 5,265,281 | 11/1993 | McAlpine | 4/287 |
| 5,418,983 | 5/1995 | Garguillo | 4/286 |

*Primary Examiner*—David J. Walczak

[57] ABSTRACT

A drain assembly for providing a leak-free linkage between a sink and a drainpipe. The drain assembly includes an inner linkage member and an outer linkage basket. The inner linkage member has inner and outer surfaces, open upper and lower ends, a basket strainer portion, an elongate drain tube portion. The inner linkage member is designed for extending through the drain opening of a sink with the upper end of the inner linkage member positioned adjacent the periphery of the drain opening of the sink and the lower end of the inner linkage member coupled to the free end of the drainpipe. The outer surface of the inner linkage member has spaced apart locking flanges extending outwardly therefrom with each locking flange defining a locking groove. The outer linkage basket has inner and outer surfaces, a bottom portion, a side portion, and an upper edge. The bottom portion of the outer linkage basket has a hole therethrough between the inner and outer surfaces of the outer linkage basket. The drain tube portion of the inner linkage member is inserted through the hole of the bottom portion of the outer linkage basket. The inner surface of the outer linkage basket has spaced apart linking arms extending radially inwards. Each of the linking arms has a hooked end which is insertable into the locking groove of an associated locking flange of the inner linkage member such that each linking arm is engaged to the associated locking flange.

9 Claims, 2 Drawing Sheets

DRAIN ASSEMBLY

BACKGROUND OF THE INVENTION

1. Field of the Invention

The present invention relates to drain assemblies and more particularly pertains to a new drain assembly for providing a leak-free linkage between a sink and a drainpipe.

2. Description of the Prior Art

The use of drain assemblies is known in the prior art. More specifically, drain assemblies heretofore devised and utilized are known to consist basically of familiar, expected and obvious structural configurations, notwithstanding the myriad of designs encompassed by the crowded prior art which have been developed for the fulfillment of countless objectives and requirements.

In particular, the traditional prior art drain assembly, or basket strainer assembly, includes a strainer basket and a traditional ring nut to link the sink to the drainpipe. Unfortunately, the traditional prior art ring nut can easily and frequently come loose from the strainer basket to cause a leak in the drainage system.

Other known prior art drain assemblies include U.S. Pat. No. 5,369,815; U.S. Pat. No. 4,594,740; U.S. Pat. No. 4,232,407; U.S. Pat. No. 5,136,736; U.S. Pat. No. 5,435,022; and U.S. Pat. No. Des. 354,119.

While these devices fulfill their respective, particular objectives and requirements, the aforementioned patents do not disclose a new drain assembly. The inventive device includes an inner linkage member and an outer linkage basket. The inner linkage member has inner and outer surfaces, open upper and lower ends, a basket strainer portion, an elongate drain tube portion. The inner linkage member is designed for extending through the drain opening of a sink with the upper end of the inner linkage member positioned adjacent the periphery of the drain opening of the sink and the lower end of the inner linkage member coupled to the free end of the drainpipe. The outer surface of the inner linkage member has a plurality of spaced apart locking flanges extending outwardly therefrom with each locking flange defining a locking groove. The outer linkage basket has inner and outer surfaces, a bottom portion, a side portion, and an upper edge. The bottom portion of the outer linkage basket has a hole therethrough between the inner and outer surfaces of the outer linkage basket. The drain tube portion of the inner linkage member is inserted through the hole of the bottom portion of the outer linkage basket. The inner surface of the outer linkage basket has a plurality of spaced apart linking arms extending radially inwards. Each of the linking arms has a hooked end which is insertable into the locking groove of an associated locking flange of the inner linkage member such that each linking arm is engaged to the associated locking flange.

In these respects, the drain assembly according to the present invention substantially departs from the conventional concepts and designs of the prior art, and in so doing provides an apparatus primarily developed for the purpose of providing a leak-free linkage between a sink and a drainpipe.

SUMMARY OF THE INVENTION

In view of the foregoing disadvantages inherent in the known types of drain assemblies now present in the prior art, the present invention provides a new drain assembly construction wherein the same can be utilized for providing a leak-free linkage between a sink and a drainpipe.

The general purpose of the present invention, which will be described subsequently in greater detail, is to provide a new drain assembly apparatus and method which has many of the advantages of the drain assemblies mentioned heretofore and many novel features that result in a new drain assembly which is not anticipated, rendered obvious, suggested, or even implied by any of the prior art drain assemblies, either alone or in any combination thereof.

To attain this, the present invention generally comprises an inner linkage member and an outer linkage basket. The inner linkage member has inner and outer surfaces, open upper and lower ends, a basket strainer portion, an elongate drain tube portion. The inner linkage member is designed for extending through the drain opening of a sink with the upper end of the inner linkage member positioned adjacent the periphery of the drain opening of the sink and the lower end of the inner linkage member coupled to the free end of the drainpipe. The outer surface of the inner linkage member has a plurality of spaced apart locking flanges extending outwardly therefrom with each locking flange defining a locking groove. The outer linkage basket has inner and outer surfaces, a bottom portion, a side portion, and an upper edge. The bottom portion of the outer linkage basket has a hole therethrough between the inner and outer surfaces of the outer linkage basket. The drain tube portion of the inner linkage member is inserted through the hole of the bottom portion of the outer linkage basket. The inner surface of the outer linkage basket has a plurality of spaced apart linking arms extending radially inwards. Each of the linking arms has a hooked end which is insertable into the locking groove of an associated locking flange of the inner linkage member such that each linking arm is engaged to the associated locking flange.

There has thus been outlined, rather broadly, the more important features of the invention in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drain assembly apparatus and method which has many of the advantages of the drain assemblies mentioned heretofore and many novel features that result in a new drain assembly which is not anticipated, rendered obvious, suggested, or even implied by any of the prior art drain assemblies, either alone or in any combination thereof.

It is another object of the present invention to provide a new drain assembly which may be easily and efficiently manufactured and marketed.

It is a further object of the present invention to provide a new drain assembly which is of a durable and reliable construction.

An even further object of the present invention is to provide a new drain assembly which is susceptible of a low cost of manufacture with regard to both materials and labor, and which accordingly is then susceptible of low prices of sale to the consuming public, thereby making such drain assembly economically available to the buying public.

Still yet another object of the present invention is to provide a new drain assembly which provides in the apparatuses and methods of the prior art some of the advantages thereof, while simultaneously overcoming some of the disadvantages normally associated therewith.

Still another object of the present invention is to provide a new drain assembly for providing a leak-free linkage between a sink and a drainpipe.

Yet another object of the present invention is to provide a new drain assembly which includes an inner linkage member and an outer linkage basket. The inner linkage member has inner and outer surfaces, open upper and lower ends, a basket strainer portion, an elongate drain tube portion. The inner linkage member is designed for extending through the drain opening of a sink with the upper end of the inner linkage member positioned adjacent the periphery of the drain opening of the sink and the lower end of the inner linkage member coupled to the free end of the drainpipe. The outer surface of the inner linkage member has a plurality of spaced apart locking flanges extending outwardly therefrom with each locking flange defining a locking groove. The outer linkage basket has inner and outer surfaces, a bottom portion, a side portion, and an upper edge. The bottom portion of the outer linkage basket has a hole therethrough between the inner and outer surfaces of the outer linkage basket. The drain tube portion of the inner linkage member is inserted through the hole of the bottom portion of the outer linkage basket. The inner surface of the outer linkage basket has a plurality of spaced apart linking arms extending radially inwards. Each of the linking arms has a hooked end which is insertable into the locking groove of an associated locking flange of the inner linkage member such that each linking arm is engaged to the associated locking flange.

Still yet another object of the present invention is to provide a new drain assembly that quickly mounts to a sink or tub and eliminates the need for a ring nut in the linkage between the sink and the drainpipe.

Even still another object of the present invention is to provide a new drain assembly that uses suction to help hold the drain assembly in place to link the sink with the drainpipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
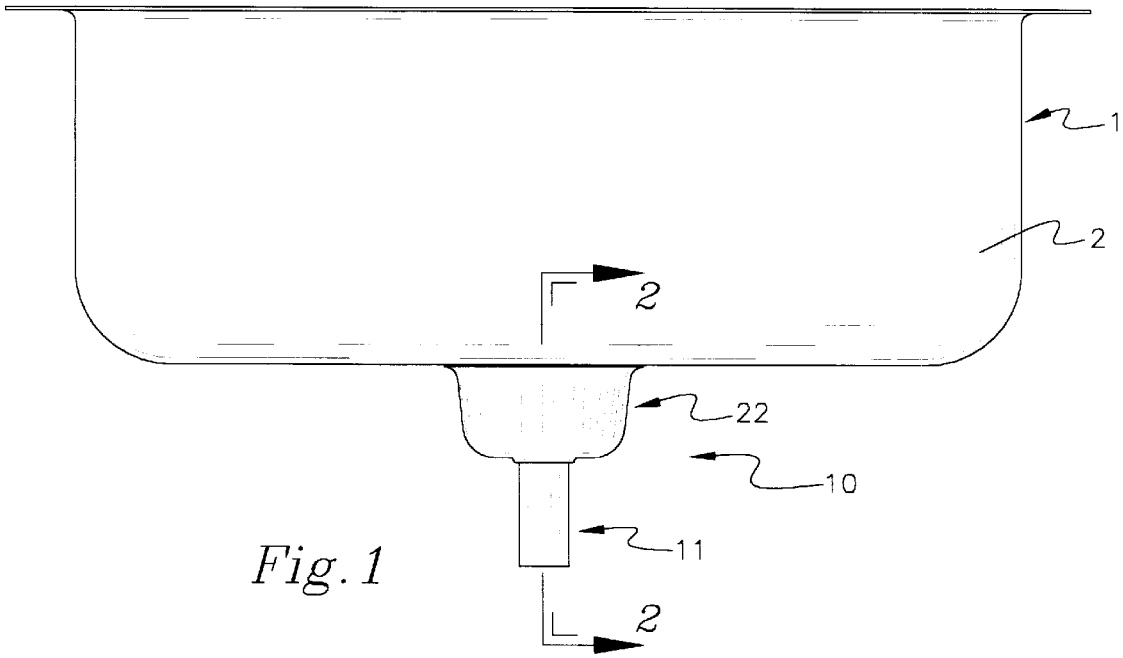
FIG. 1 is a schematic side view of a new drain assembly according to the present invention.

With reference now to the drawings, and in particular to FIGS. 1 through 5 thereof, a new drain assembly embodying the principles and concepts of the present invention and generally designated by the reference numeral 10 will be described.

Figure 2:
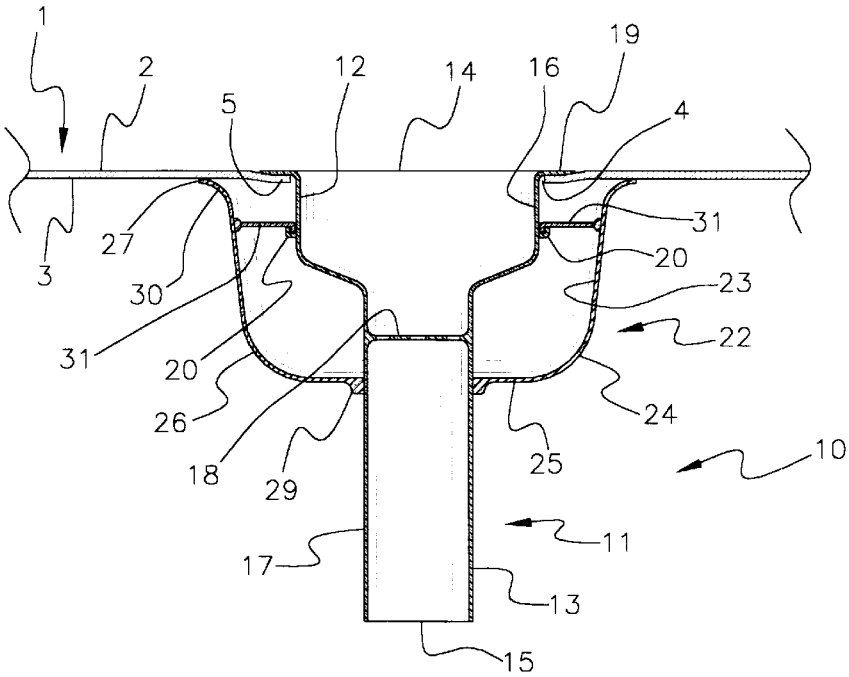
FIG. 2 is a schematic cross-sectional view taken from line 2—2 on FIG. 1 of the present invention.
Figure 3:
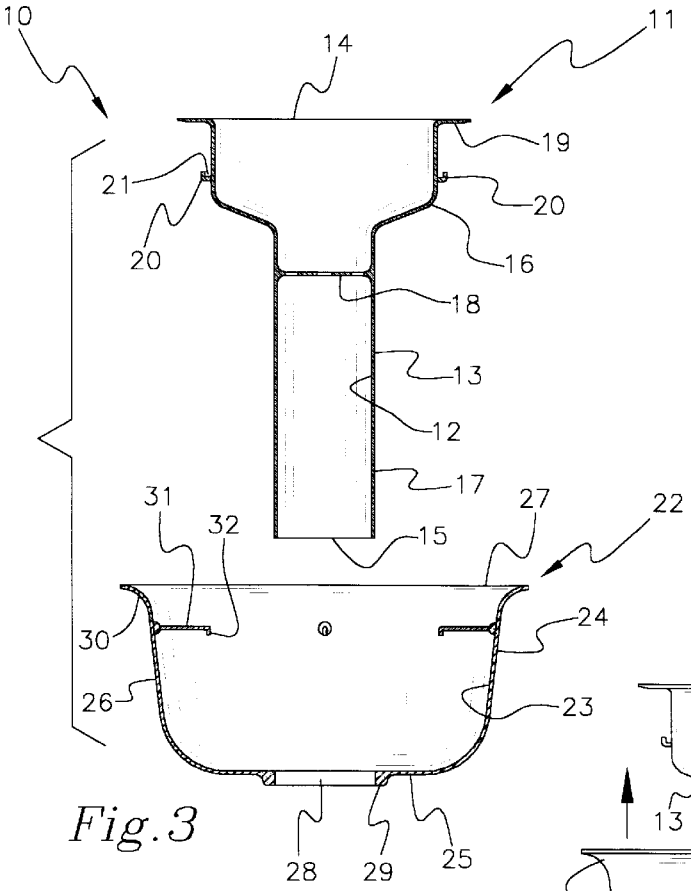
FIG. 3 is a schematic exploded cross-sectional view of the present invention.
Figure 4:
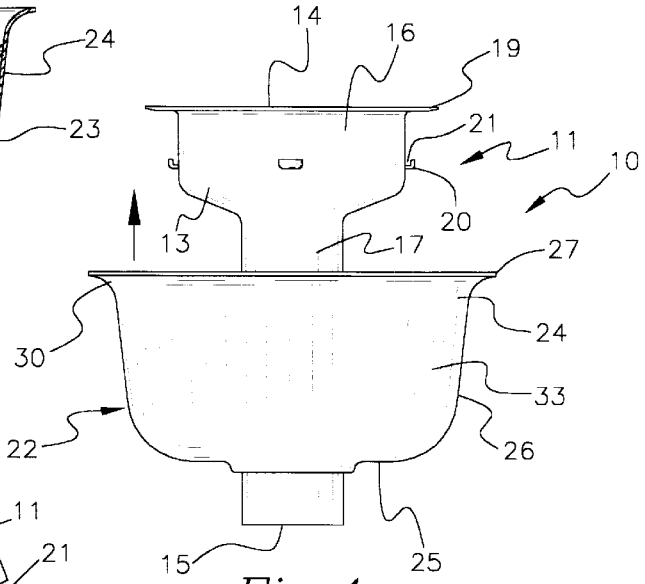
FIG. 4 is a schematic side view of the present invention.
Figure 5:
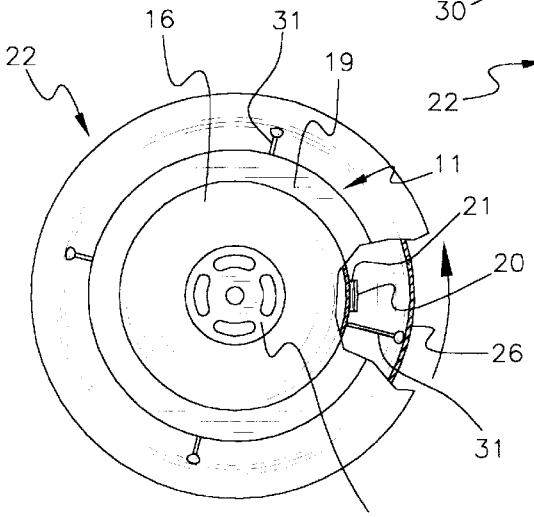
FIG. 5 is a schematic top partial breakaway view of the present invention.

As illustrated in FIGS. 1 and 2, the drain assembly 10 designed for fluidly connecting a sink 1 to a drainpipe. The sink 1 has interior and exterior surfaces 2,3 and a drain opening 4 therethrough between the interior and exterior surfaces 2,3 of the sink 1. The drain opening 4 has a generally circular periphery and preferably an annular lip 5 extending around the periphery of the drain opening 4. The drainpipe has an open end located near the drain opening 4 of the sink 1. As best illustrated in FIGS. 1 through 5, the drain assembly 10 generally comprises an inner linkage member 11 and an outer linkage basket 22. The inner linkage member 11 has inner and outer surfaces 12,13, open upper and lower ends 14,15, a basket strainer portion 16, and an elongate drain tube portion 17. The inner linkage member 11 is designed for extending through the drain opening 4 of a sink 1 with the upper end 14 of the inner linkage member 11 positioned adjacent the periphery of the drain opening 4 of the sink 1 and the lower end 15 of the inner linkage member 11 coupled to the free end of the drainpipe. The outer surface of the inner linkage member 11 has a plurality of spaced apart locking flanges 20 extending outwardly therefrom with each locking flange defining a locking groove 21. The outer linkage basket 22 has inner and outer surfaces 23,24, a bottom portion 25, a side portion 26, and an upper edge 27. The bottom portion 25 of the outer linkage basket 22 has a hole 28 therethrough between the inner and outer surfaces of the outer linkage basket 22. The drain tube portion 17 of the inner linkage member 11 is inserted through the hole 28 of the bottom portion 25 of the outer linkage basket 22. The inner surface 23 of the outer linkage basket 22 has a plurality of spaced apart linking arms 31 extending radially inwards. Each of the linking arms 31 has a hooked end 32 which is insertable into the locking groove 21 of an associated locking flange of the inner linkage member 11 such that each linking arm is engaged to the associated locking flange.

Specifically, the inner linkage member 11 has inner and outer surfaces 12,13, open upper and lower ends 14,15, an upper basket strainer portion 16, an elongate lower drain tube portion 17, and a longitudinal axis extending between the upper and lower ends 12,13 of the inner linkage member 11. The basket strainer portion 16 is positioned adjacent the upper end 14 of the inner linkage member 11 and the drain tube portion 17 is positioned adjacent the lower end 15 of the inner linkage member 11. The drain tube portion 17 is generally cylindrical and has a diameter. The basket strainer portion 16 has a diameter greater than the diameter of the drain tube portion 17. The basket strainer portion 16 and the drain tube portion 17 are integrally formed so that the inner linkage member 11 is a single piece. The inner surface of the inner linkage member 11 forms a passage therethrough between the upper and lower ends 14,15 of the inner linkage member 11. The passage is designed for permitting drainage of the sink 1 into the drainpipe through the passage of the inner linkage member 11. The basket strainer portion 16 may also include a straining grate 18 extending across the passage of the inner linkage member 11 to prevent excessively sized debris from passing from the sink 1 to the drain pip through the passage. The upper end 14 of the inner linkage member 11 preferably has an annular cuter flange 19 extending radially outwards therefrom. In use, the inner linkage member 11 is designed for extending through the drain opening 4 of a sink 1. The upper end of the inner linkage is designed for positioning adjacent the periphery of the drain opening 4 of the sink 1, with the outer flange 19 of the upper end 14 of the inner linkage member 11 resting on the annular lip 5 around the periphery of the drain opening 4 of the sink 1. The lower end 15 of the inner linkage member 11 is designed for coupling to the free end of the drainpipe.

The outer surface of the inner linkage member 11 has a plurality of spaced apart locking flanges 20 extending outwardly therefrom. Each of the locking flanges 20 has a generally L-shaped cross section such that each of the locking flanges 20 defines a locking groove 21 facing towards the upper end 14 of the inner linkage member 11. The locking flanges 20 are positioned on the basket strainer portion 16 such that the locking flanges 20 lie in a plane generally perpendicular to the longitudinal axis of the inner linkage member 11. In an ideal illustrative embodiment, the basket strainer portion 16 has a length defined parallel to the longitudinal axis of the inner linkage member 11 of about 2 inches and the drain tube portion 17 has a length defined parallel to the longitudinal axis of the inner linkage member 11 between about 4 inches and about 6 inches.

The outer linkage basket 22 has a central axis, inner and outer surfaces 23,24, a bottom portion 25, a side portion 26, and an upper edge 27. The inner surface 23 of the outer linkage basket 22 defines the interior space of the outer linkage basket 22. The bottom portion 25 of the outer linkage basket 22 has a hole 28 therethrough between the inner and outer surfaces 23,24 of the outer linkage basket 22. The hole 28 of the bottom portion 25 has a generally circular periphery and has a center coaxial with the central axis of the outer linkage. The hole 28 of the bottom portion 25 has a diameter slightly greater than the diameter of the drain portion of the inner linkage member 11. The drain tube portion 17 of the inner linkage member 11 is inserted through the hole 28 of the bottom portion 25 of the outer linkage basket 22 so that the outer linkage basket 22 is slidable along the length of the drain tube portion 17 such that the basket strainer portion 16 of the inner linkage member 11 is positionable in the interior space of the outer linkage basket 22. The periphery of the hole 28 of the bottom portion 25 of the outer linkage basket 22 preferably has a thickened region 29 therearound. The thickened region 29 of the periphery of the hole 28 is designed for providing a generally air-tight seal between the outer surface of the drain tube of the inner linkage member 11 and the periphery of the hole 28 of the bottom portion 25 of the outer linkage basket 22 to prevent the passage of air and liquid between the outer surface of the drain tube of the inner linkage member 11 and the periphery of the hole 28 of the bottom portion 25 of the outer linkage basket 22.

Preferably, the upper edge 27 of the outer linkage basket 22 flares radially outwards from the central axis of the outer linkage basket 22 to form a flared portion 30. The flared portion 30 is designed for abutting against the exterior surface of the sink 1 around the periphery of the drain opening 4 of the sink 1. Ideally, outer linkage basket comprises a flexible material, such as a flexible plastic or rubber, sufficiently flexible to permit outwards flexing of the flared portion 30 of the outer linkage basket against the exterior surface of the sink 1 when the outer linkage basket is pushed against the exterior surface of the sink 1. This permits a generally air-tight seal to form between the flared portion 30 of the outer linkage basket 22 and the exterior surface of the sink 1 around the drain opening 4 of the sink 1 to prevent air and fluid from passing therebetween. In use, the pushing of the outer linkage basket 22 pushes air in the interior space of the outer linkage basket 22 such that the air pressure inside the interior space of the outer linkage basket 22 is less than the air pressure of the environment outside the outer surface 24 of the outer linkage basket 22.

The inner surface 23 of the outer linkage basket 22 has a plurality of spaced apart linking arms 31 extending radially inwards towards the central axis of the outer linkage basket 22. The linking arms 31 are positioned on the side portion 26 of the outer linkage basket. Each of the linking arms 31 has a downwardly extending hooked end 32. In use, after pushing the outer linkage basket 22 against the sink 1. The outer linkage basket 22 is then turned about its central axis such that the hooked end 32 of each of the linking arms 31 is insertable into the locking groove 21 of an associated locking flange of the inner linkage member 11 such that each linking arm is engaged to the associated locking flange. This engagement of the linking arms 31 to the locking flanges 20 is designed for holding the outer linkage basket 22 to the inner linkage member 11 when the drain assembly is assembled. Ideally, the outer surface of the side wall of the outer linkage basket 22 is knurled 33 to provide a frictionally enhanced surface with respect to a smooth surface for aiding the grip of the user when turning the outer linkage basket 22 about the inner linkage member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain assembly for fluidly connecting a sink to a drainpipe, the sink having interior and exterior surfaces and a drain opening therethrough between the interior and exterior surfaces of the sink, the drain opening having a generally circular periphery and an annular lip extending around the periphery of the drain opening, the drainpipe having an free end, said drain assembly comprising:

an inner linkage member having inner and outer surfaces, open upper and lower ends, a basket strainer portion, an elongate drain tube portion, and a longitudinal axis extending between said upper and lower ends of said inner linkage member;

said inner linkage member being adapted for extending through the drain opening of a sink, said upper end of said inner linkage being adapted for positioning adjacent the periphery of the drain opening of the sink, said lower end of said inner linkage member being adapted for coupling to the free end of the drainpipe;

said outer surface of said inner linkage member having a plurality of spaced apart locking flanges extending outwardly therefrom, each of said locking flanges defining a locking groove;

an outer linkage basket having a central axis, inner and outer surfaces, a bottom portion, a side portion, and an upper edge, said inner surface of said outer linkage basket defining an interior space of said outer linkage basket;

said bottom portion of said outer linkage basket having a hole therethrough between said inner and outer surfaces of said outer linkage basket;

said drain tube portion of said inner linkage member being inserted through said hole of said bottom portion of said outer linkage basket;

said inner surface of said outer linkage basket having a plurality of spaced apart linking arms extending radially inwards towards said central axis of said outer linkage basket, said linking arms being positioned on said side portion of said outer linkage portion; and each of said linking arms having a hooked end, said hooked end of each of said linking arms being insertable into the locking groove of an associated locking flange of said inner linkage member such that each linking arm is engaged to the associated locking flange.

2. The drain assembly of claim 1, wherein said upper end of said inner linkage member has an annular outer flange extending radially outwards therefrom, said outer flange of said upper end of said inner linkage member being adapted for resting on the annular lip around the periphery of the drain opening of the sink.

3. The drain assembly of claim 1, wherein said locking flanges are positioned on said basket strainer portion such that said locking flanges lie in a plane generally perpendicular to said longitudinal axis of said inner linkage member.

4. The drain assembly of claim 1, wherein said basket strainer portion has a length defined parallel to said longitudinal axis of said inner linkage member of about 2 inches, wherein said drain tube portion has a length defined parallel to said longitudinal axis of said inner linkage member between about 4 inches and about 6 inches.

5. The drain assembly of claim 1, wherein said hole of said bottom portion has a generally circular periphery and having a center coaxial with said central axis of said outer linkage, said hole of said bottom portion having a diameter slightly greater than said diameter of said drain portion of said inner linkage member.

6. The drain assembly of claim 5, wherein said periphery of said hole of said bottom portion of said outer linkage basket has a thickened region therearound, said thickened region of said periphery of said hole being for providing a generally air-tight seal between said outer surface of said drain tube of said inner linkage member and said periphery of said hole of said bottom portion of said outer linkage basket to prevent the passage of air and liquid between said outer surface of said drain tube of said inner linkage member and said periphery of said hole of said bottom portion of said outer linkage basket.

7. The drain assembly of claim 1, wherein said upper edge of said outer linkage basket flares radially outwards from said central axis of said outer linkage basket to form a flared portion, said flared portion being adapted for abutting against the exterior surface of the sink around the periphery of the drain opening of the sink.

8. The drain assembly of claim 7, wherein said outer linkage basket comprises a flexible material sufficiently flexible to permit outwards flexing of said flared portion of said outer linkage portion against the exterior surface of the sink when said outer linkage basket is pushed against the exterior surface of the sink such that a generally air-tight seal is formed between said flared portion of said outer linkage basket and the exterior surface of the sink around the drain opening of the sink to prevent air and fluid from passing therebetween.

9. A drain assembly for fluidly connecting a sink to a drainpipe, the sink having interior and exterior surfaces and a drain opening therethrough between the interior and exterior surfaces of the sink, the drain opening having a generally circular periphery and an annular lip extending around the periphery of the drain opening, the drainpipe having an free end, said drain assembly comprising:

an inner linkage member having inner and outer surfaces, open upper and lower ends, a basket strainer portion, an elongate drain tube portion, and a longitudinal axis extending between said upper and lower ends of said inner linkage member;

said basket strainer portion being positioned adjacent said upper end of said inner linkage member, said drain tube portion being positioned adjacent said lower end of said inner linkage member, said drain tube portion being generally cylindrical and having a diameter;

said upper end of said inner linkage member having an annular outer flange extending radially outwards therefrom;

said inner linkage member being adapted for extending through the drain opening of a sink, said upper end of said inner linkage being adapted for positioning adjacent the periphery of the drain opening of the sink, said outer flange of said upper end of said inner linkage member being adapted for resting on the annular lip around the periphery of the drain opening of the sink, said lower end of said inner linkage member being adapted for coupling to the free end of the drainpipe;

said outer surface of said inner linkage member having a plurality of spaced apart locking flanges extending outwardly therefrom, each of said locking flanges having a generally L-shaped cross section such that each of said locking flanges defines a locking groove;

said locking flanges being positioned on said basket strainer portion such that said locking flanges lie in a plane generally perpendicular to said longitudinal axis of said inner linkage member;

wherein said basket strainer portion has a length defined parallel to said longitudinal axis of said inner linkage member of about 2 inches, wherein said drain tube portion has a length defined parallel to said longitudinal axis of said inner linkage member between about 4 inches and about 6 inches;

an outer linkage basket having a central axis, inner and outer surfaces, a bottom portion, a side portion, and an upper edge, said inner surface of said outer linkage basket defining an interior space of said outer linkage basket;

said bottom portion of said outer linkage basket having a hole therethrough between said inner and outer surfaces of said outer linkage basket, said hole of said bottom portion having a generally circular periphery and having a center coaxial with said central axis of said outer linkage;

said hole of said bottom portion having a diameter slightly greater than said diameter of said drain portion of said inner linkage member;

said drain tube portion of said inner linkage member being inserted through said hole of said bottom portion of said outer linkage basket, said outer linkage basket being slidable along the length of the drain tube portion such that said basket strainer portion of said inner linkage member is positionable in said interior space of said outer linkage basket;

said periphery of said hole of said bottom portion of said outer linkage basket having a thickened region therearound, said thickened region of said periphery of said hole being for providing a generally air-tight seal between said outer surface of said drain tube of said inner linkage member and said periphery of said hole of said bottom portion of said outer linkage basket to prevent the passage of air and liquid between said outer surface of said drain tube of said inner linkage member and said periphery of said hole of said bottom portion of said outer linkage basket;

said upper edge of said outer linkage basket flaring radially outwards from said central axis of said outer linkage basket to form a flared portion, said flared portion being adapted for abutting against the exterior surface of the sink around the periphery of the drain opening of the sink;

wherein said outer linkage basket comprises a flexible material sufficiently flexible to permit outwards flexing of said flared portion of said outer linkage basket against the exterior surface of the sink when said outer linkage portion is pushed against the exterior surface of the sink such that a generally air-tight seal is formed between said flared portion of said outer linkage basket and the exterior surface of the sink around the drain opening of the sink to prevent air and fluid from passing therebetween;

said inner surface of said outer linkage basket having a plurality of spaced apart linking arms extending radially inwards towards said central axis of said outer linkage basket, said linking arms being positioned on said side portion of said outer linkage portion; and each of said linking arms having a said hooked end of each of said linking arms being insertable into the locking groove of an associated locking flange of said inner linkage member such that each linking arm is engaged to the associated locking flange.

* * * * *